US009421760B2

(12) United States Patent
Till

(10) Patent No.: US 9,421,760 B2
(45) **Date of Patent: *Aug. 23, 2016**

(54) PLANT FOR PRINTING CONTAINERS

(71) Applicant: KHS GmbH, Dortmund (DE)

(72) Inventor: Heinz Till, Hofheim am Taunus (DE)

(73) Assignee: KHS GmbH, Dortmund (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/806,784

(22) Filed: Jul. 23, 2015

(65) Prior Publication Data

US 2016/0023459 A1 Jan. 28, 2016

Related U.S. Application Data

(63) Continuation of application No. 13/384,695, filed as application No. PCT/EP2010/004162 on Jul. 8, 2010, now Pat. No. 9,090,091.

(30) Foreign Application Priority Data

Jul. 18, 2009 (DE) ..... 10 2009 033 810

(51) Int. Cl.
*B41F 17/00* (2006.01)
*B41J 2/045* (2006.01)
(Continued)

(52) U.S. Cl.
CPC ..... *B41J 2/04505* (2013.01); *B41F 17/18* (2013.01); *B41F 17/28* (2013.01); *B41J 2/01* (2013.01); *B41J 3/4073* (2013.01); *B41J 3/543* (2013.01); *B41J 11/002* (2013.01)

(58) Field of Classification Search
CPC ..... B41J 3/4073; B41J 3/407; B41J 2/04; B41J 11/002; B41F 15/30; B41F 17/006; B41F 17/18; B41F 17/14; B41F 17/20; B41F 17/28; B41F 17/30; B41P 2217/00; B41P 2217/61; B41P 2217/62
USPC ..... 101/35, 36, 38.1, 40, 40.1, 484–486; 347/4
See application file for complete search history.

(56) References Cited

U.S. PATENT DOCUMENTS 5,121,827 A * 6/1992 Ribordy ..... B65C 9/04 101/40
6,295,737 B2 * 10/2001 Patton ..... 101/35
(Continued)

FOREIGN PATENT DOCUMENTS

CA 2568736 5/2008 ..... B41J 11/0015
DE 4009642 8/1991
(Continued)

*Primary Examiner* — Blake A Tankersley
*Assistant Examiner* — Marissa Ferguson Samreth
(74) *Attorney, Agent, or Firm* — Occhiuti & Rohlicek LLP

(57) ABSTRACT

An apparatus for printing a design on a container includes first and second pluralities of printing stations for printing corresponding first and second colors, with the second plurality following the first. A controller operably interlinks the first and second pluralities of printing stations. Each printing station includes a print head that has an adjustable position and orientation relative to a container. A measuring device having sensors arranged to measure a distance between the print head and the container determines this. The measuring device receives, from the sensors, information representative of the print head's position and orientation relative to the container and provides it to the controller, which then adjusts it.

14 Claims, 4 Drawing Sheets

(51) Int. Cl.

| | |
|---|---|
| ***B41F 17/18*** | (2006.01) |
| ***B41J 2/01*** | (2006.01) |
| ***B41F 17/28*** | (2006.01) |
| ***B41J 3/407*** | (2006.01) |
| ***B41J 3/54*** | (2006.01) |
| *B41J 11/00* | (2006.01) |

(56) References Cited

U.S. PATENT DOCUMENTS

| | | | | |
|---|---|---|---|---|
| 6,769,357 | B1 | 8/2004 | Finan | 101/38.1 |
| 7,210,408 | B2 | 5/2007 | Uptergrove | 101/35 |
| 8,256,854 | B2 * | 9/2012 | Till | B41F 17/18 347/101 |
| 9,090,091 | B2 * | 7/2015 | Till | B41J 3/4073 |
| 2005/0045263 | A1 * | 3/2005 | Heuft | B65C 9/06 156/64 |
| 2006/0144261 | A1 | 7/2006 | Uptergrove | 101/35 |
| 2009/0294069 | A1 * | 12/2009 | Kramer | B65C 9/04 156/362 |
| 2010/0192517 | A1 * | 8/2010 | Schach | B41J 2/0057 53/411 |
| 2010/0257819 | A1 | 10/2010 | Schach | 53/411 |

FOREIGN PATENT DOCUMENTS

| | | | |
|---|---|---|---|
| DE | 19532724 | 3/1997 | B41J 11/20 |
| DE | 29818055 | 4/1999 | B41J 25/308 |
| DE | 19927668 | 12/2000 | B65C 9/067 |
| DE | 10115543 | 10/2002 | B41J 2/06 |
| DE | 102006001223 | 7/2007 | B41J 2/06 |
| DE | 102006019441 | 10/2007 | B41J 11/002 |
| DE | 102007036752 | 2/2009 | B41J 3/407 |
| DE | 102007050490 | 4/2009 | B41F 17/08 |
| EP | 0209896 | 1/1987 | B05B 13/04 |
| EP | 0931649 | 7/1999 | B41J 2/01 |
| WO | 99/08935 | 2/1999 | B41J 2/01 |
| WO | 2004/016438 | 2/2004 | B41J 3/407 |
| WO | 2011/009536 | 1/2011 | B41J 3/407 |

* cited by examiner

PLANT FOR PRINTING CONTAINERS

RELATED APPLICATIONS

Under 35 USC 120, this application is a continuation of U.S. application Ser. No. 13/384,695, issued as U.S. Pat. No. 9,090,091 on Jul. 28, 2015, which was the national stage application of International Application No. PCT/EP2010/004162, filed Jul. 8, 2010, which claims the benefit of the Jul. 18, 2009 priority of German application no. 10 2009 033 810.1. The contents of the foregoing applications are incorporated herein in their entirety.

FIELD OF INVENTION

The invention relates to a plant for printing containers such as bottles with a print image (script and/or image patterns) on at least one printing machine with at least one printing head and to a method carried out thus.

BACKGROUND

It is known to label containers with labels that provide consumer information. It is also known to apply individualized marks or other information to containers using ink jet printers in ways that are not permitted by label printing. Known printing systems that can do this work in monochrome and cannot print more than a few printing dots or lines.

It is known, furthermore, that work is in progress on printing methods and systems that make possible printing of widths of up to 174 mm per printing head using printing heads of different manufacturers. These printing heads also work in monochrome.

For multicolor printing, printing heads have to be arranged one after the other and suitably offset so that, depending on the number of colors, an even pitch between individual printing dots is achieved. This is possible with an adjustment on a machine having a plurality of printing heads arranged one after the other in a fixed manner. In these machines, the packaging to be printed upon is moved past the printing heads with constant speed. The performance of such a machine therefore depends on the printing speed of a respective printing head.

Machines along the lines of the foregoing are practicable for printing on absorbent packaging materials. However, if one wishes to print on a non-absorbent material, such as metal, glass or plastic, the ink has to cured between colors, for example by heat drying, or by UV or electron beams through cross-linking. The need to cure between colors increases the length of such machines. If one wishes to increase the performance, either a plurality of printing systems have to be connected in parallel, or a different arrangement has to be selected.

The prior art has also suggested arranging holders on a carousel for packing material to be printed in circular form and rotating the individual packaging itself on the individual station during the rotation of the carousel and thus guiding the surface of the packaging past printing heads arranged on each station and oriented relative to one another. A disadvantage of this is that with surfaces that require the use of inks to be cured by UV or electron beams, no intermediate drying or cross-linking of the individual printing inks is possible.

There is therefore the additional proposal of applying each color on individual carousels arranged one after the other in series, wherein the drying/cross-linking can take place during the transfer between the individual carousels. It is provided, with this embodiment, to fasten the container or the packages on a belt clamped in an independent transport unit, thus moving these in a centered manner one after the other through the various carousels arranged one after the other. This holding device would have to be embodied as a rotary mounting so that the containers drive one another on the carousels and thus are guided past the individual printing head of the respective color with the entire surface.

It was proposed, furthermore, to clamp containers in individual holding devices, wherein each holding device rotatably receives the container and has a marking for the 0 degree angle clamped-in. The containers are individually transported and received with the holding device in printing machines connected in series. Here, the holding device and the mounting are designed so that a centering of the holding device in the machine takes place with such precision that the container is oriented to match the print image of the corresponding printing head and through the 0 degree marking, also matching with respect to the rotary axis.

The requirements of centering and maintaining the accuracy of the guide for achieving a high-quality print image, however, are high. Doing so is a complex undertaking since, during start-up and braking, different tensile forces act on the belt. Temperature fluctuations can additionally occur. Both of these effects can lead to tolerances being exceeded to the point where they cannot be compensated for. To make matters worse, a container can sometimes be quite heavy. For example, when the container is a bottle, the printing normally takes place after the bottle has been filled. Added to all this weight is the mass of the holding device itself.

The precision of the centering requirement becomes clear when one knows that with the usual 600 dpi of printing quality, the printing dots are 0.042 mm apart from one another. This means that a holding device that is holding a rather heavy bottle filled with liquid has to somehow be permanently aligned to 1/100 mm. With processing quantities of, for example, 36,000 bottles/hour in the beverage industry, more than 200,000,000 bottles pass through such a machine in a year. Because of this, the wear is huge, and substantially influences the printing quality.

SUMMARY

The object of the present invention is to propose a plant of the type mentioned at the outset, with the help of which reliable operation, high printing quality, and high printing output can be achieved.

This object is solved by having at least one printing head that is automatically adjustable by means of an electric control device and an adjusting value. The control device moves the printing head into a position according to location coordinates and/or angular position. This is determined or calculated from the surface contour and the position of the bottle to be printed relative to the printing head by means of a capturing device that has, for example, sensors.

In this manner it is ensured that, with little time expenditure, a perfect print image can be applied to the container.

In the plant according to the invention, at least one further printing machine of the type identified beforehand can be arranged downstream of the first printing machine for printing with the same color or with a different color, so that, with the same advantage, different-color print images can be created.

The at least two printing machines can operate individually and independently of each other. Or they can be interlinked by way of control in order to apply the multi-colored print image to the container.

To further improve the accuracy of the print image, it is proposed furthermore to have a printing machine print a marking on a container with the help of which a positioning and/or alignment of the printing head of a further printing machine takes place.

The marking can additionally be provided on the print image, for example as an irregular polygon, particularly as an isosceles triangle. But a part of the print image can itself serve as a marking.

The marking can be captured via a camera or an image-processing device comprising, for example, sensors. The camera or image-processing device emits a corresponding output signal to the printing head for positioning it correctly.

Advantageously, with the help of the data gained from the marking, the printing head of a printing machine connected downstream is adjusted for printing with the same or a further color on the print image of a preceding printing machine. This can be done using stepping or servo motors to adjust height position, container spacing and/or inclination.

In a practical configuration of the plant according to the invention, the respective container to be printed is introduced into a station of a carousel (i.e. a rotational treatment machine) by means of an inlet star from, for example, a linear conveying device, that is centered in a clamping device, and put into rotary motion for printing.

Here, with the help of the data gained from the marking, the rotational angle of the container at which printing commences can be determined.

Advantageously, the respective container during a circulation of the carousel is subjected to a revolution in a station while its surface is being printed.

After this, the respective printed container can be transported out of the carousel by means of a discharge star and, if applicable, the applied ink can be cured, for example by passing the container through a UV-tunnel before introducing it into a further printing machine, if applicable of the same design, for further printing in the same manner.

Accordingly, the invention can also be carried out on linear machines.

In one aspect, the invention features an apparatus for printing a design on a container. Such an apparatus includes first and second pluralities of printing stations for printing corresponding first and second colors, with the second plurality following the first. A controller operably interlinks the first and second pluralities of printing stations. Each printing station from the first and second plurality of printing stations includes a print head that has an adjustable position and orientation relative to a container, and a measuring device configured to determine the position and orientation of the print head relative to the container. The measuring device includes sensors that are arranged such that a distance between the print head and the container is continuously measurable. The measuring device is configured to receive, from the sensors, information representative of the position and orientation of the print head relative to the container and to provide the information to the controller. The position and orientation of the print head relative to the container is adjustable by the controller based at least in part on the information provided by the measuring device.

Embodiments include those in which the first plurality of printing stations is disposed on a carousel and those in which the second plurality of printing stations is configured to print using an ink that differs in color from an ink used by the first plurality of printing stations.

Also among the embodiments are those in which the first and second pluralities of printing stations operate individually and independently of each other, and those in which the first and second pluralities of printing stations are interlinked in control.

Some embodiments further include an infeed starwheel, a carousel, a linear conveying device, a clamping device, and a printing station selected from either the first or second pluralities of printing stations. The printing station is disposed on the carousel and the infeed starwheel is configured to receive a container from the linear conveying device and to introduce the container into the printing station of the carousel. The clamping device is configured to center the received container and to place the container into rotation.

In yet other embodiments, the first plurality of printing stations is configured to print a marker on the container. A camera captures an image of the marker and emits an alignment signal for positioning the printing head of the second plurality of printing stations.

Some embodiments also include a UV source to cure ink that has been applied to the container. Among these are embodiments in which the UV source is disposed between the first and second pluralities of printing stations rotary printing machines such that a container that has been printed on by the first plurality of printing stations is illuminated by the UV source on its way to the second plurality of printing stations. As a result, ink placed on the container by the first plurality of printing stations is cured by the time the container arrives at the second plurality of printing stations.

Other embodiments include those in which the first plurality of printing stations is configured to print a marker on the container, and the second rotary printing machine is configured to use the marker as a basis for either positioning or aligning a print head of the second rotary printing machine. A variety of markers is possible. These include an irregular polygon, an isosceles triangle, and a marker that is part of the design.

In some of the foregoing embodiments, the first plurality of printing stations is disposed on a carousel, and each of the printing stations is configured to rotate the container during a revolution of the carousel by at least one complete rotation while the container is being printed upon.

BRIEF DESCRIPTION OF THE DRAWINGS

Further objectives, features, advantages and application possibilities of the invention are obtained from the following description of exemplary embodiments by means of the drawings, in which.

DETAILED DESCRIPTION

FIG. 1 shows locations at which, in principle, for example, a bottle-shaped container B can be printed by means of a printing head 1, i.e. particularly on the belly (print image surface FB) and on the neck (print image surface FH). During printing, the container B is located, for example, on a turntable 2 (see FIGS. 3*a* and 3*b*) where it is put into rotary motion during the printing process. The print image D is applied to the surface of the container B in the region of the print image surface FB and/or FH. The position of the printing head 1 by location coordinates and angular position is automatically determined through the shape and position of the container B as sensed with the help of a camera or an image-processing device. The camera or image-processing device in turn emits corresponding alignment signals to the printing head 1 via a control device.

Since the print image surface F of the container B can be at a height that is different from that of the turntable 2, the printing head 1 is adjustable in its height position (z-axis). The distance (x-axis) of the printing head 1 from the container axis A is likewise adjustable, as is the angular position of the printing head 1 as a function of the container shape and the alignment of the container.

In the case of a bottle, the center points of a bottle's bottom and a bottle's mouth, for example, may not be in the same position that they were in at the previous printing machine. Additionally, the bottle may not be perpendicular at the second printing station. Alignment in the angles $\alpha$1 and $\alpha$2 is provided also for that reason (see FIG. 1*d*).

Figure 1A:
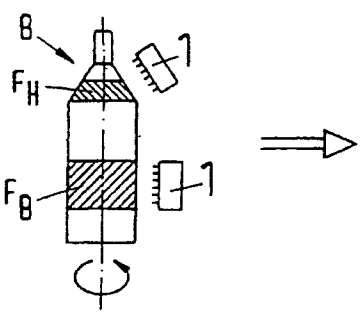
FIGS. 1*a* to 1*d* show positions of a printing head of a printing machine of a plant according to the invention relative to a bottle.
Figure 1B:
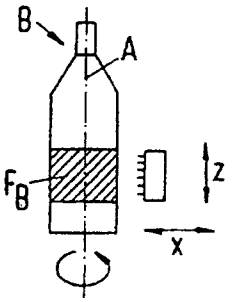
Figure 1C:
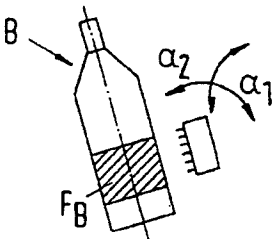
Figure 1D:
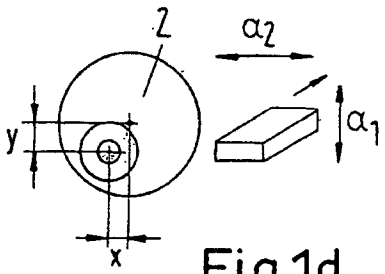
Figure 2:
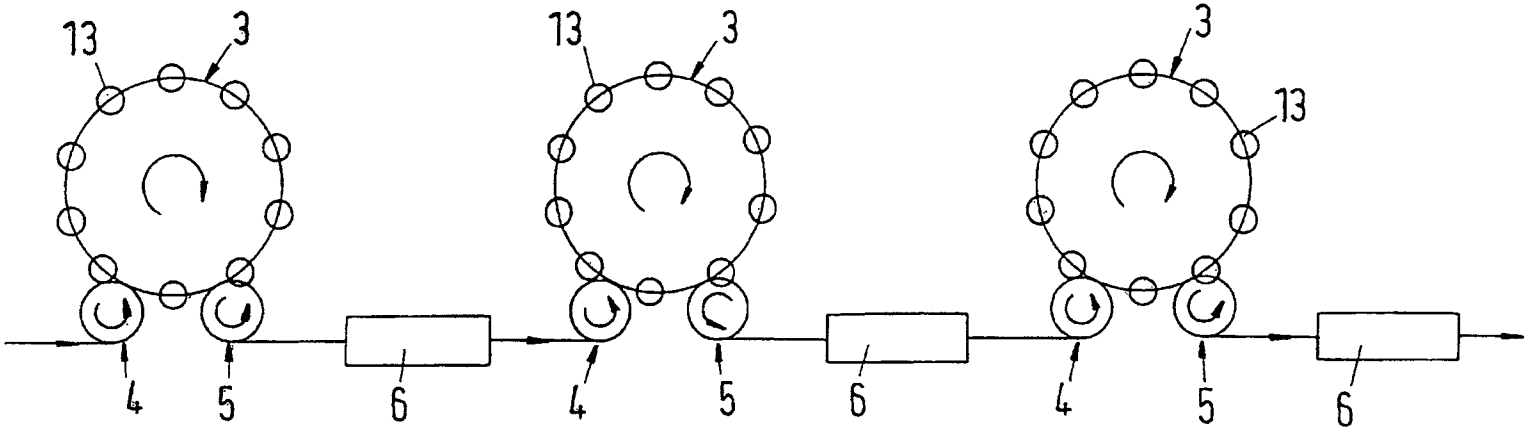
FIG. 2 shows an arrangement of three printing machines one after the other in a plant according to the invention.

FIG. 2 illustrates a plant according to the invention for printing containers B with three rotational treatment machines (carousels) 3 connected one after the other, each carousel 3 having a plurality of printing stations 13. The unprinted containers B are initially brought into the first carousel 3 from a linear conveying section by an inlet star 4 and there centered and clamped on a turntable 2 at one of the stations 13 (see FIGS. 3*a* and 3*b*).

During printing, the containers B rotate about their axis A in such a manner that they are subjected to one revolution during a circulation of the carousel 3. A discharge star 5 then transports the printed containers B into the conveying section. After drying or curing of the ink, for example, in a UV-tunnel 6, the container B reaches a second printing machine, which comprises a carousel 3 for applying the next color. For example, a container B, from the fourth station 13 of the first printing machine can be placed at the fifth station 13 of the second or the seventh station 13 of a following third printing machine. Since a printing process, including container alignment, takes approximately two seconds, the carousels with ten containers per second process 36,000 containers per hour therefore have approximately eight to nine stations 13 including inlet/outlet. Aligning the tolerances of six printing machines in the case of a six-color print and nine stations each, i.e. 72 stations in total, such that all containers receive the print image D accurately to 1/100 mm is impossible. For this reason it is important that the distance of the printing head 1 from the turntable middle (in x-direction) be adjustable.

Figure 3B:
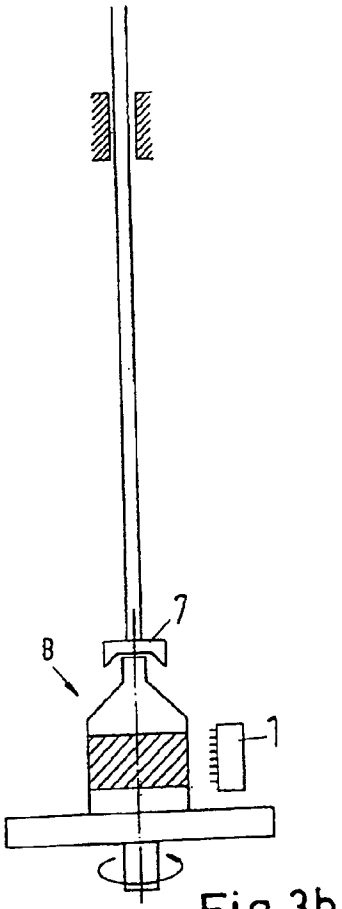
FIGS. 3*a* and 3*b* show a centering clamping device for two containers of different size in a printing station.
Figure 3A:
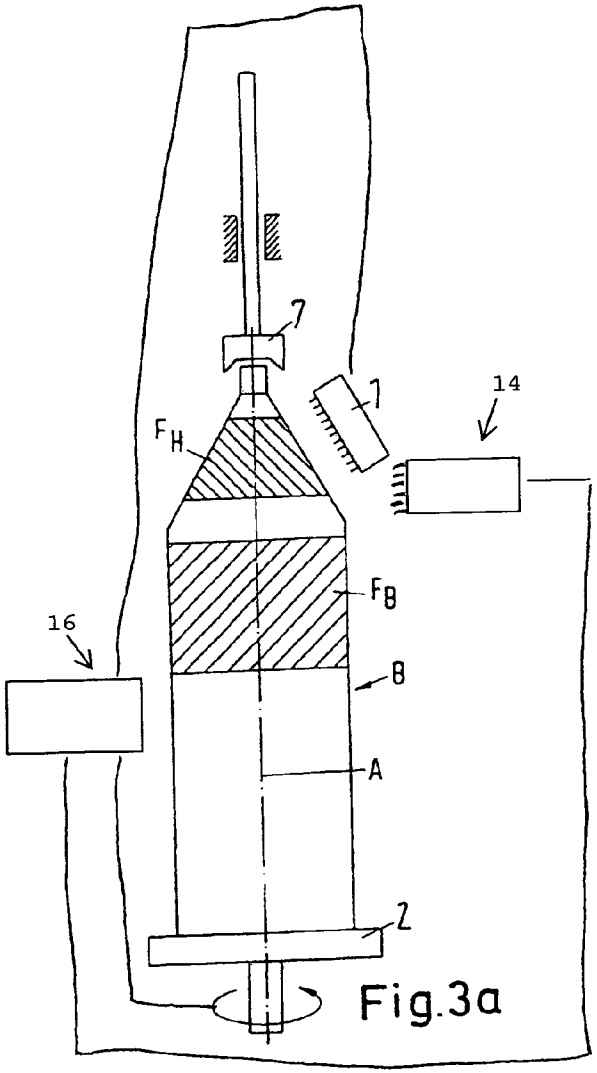

FIGS. 3*a* and 3*b* illustrate the clamping of different containers B between a lower turntable 2 and an adjustable counter-holder 7. One then distinguishes an adjustment in the x-axis and the z-axis and of the angles $\alpha$1 and $\alpha$2 when changing over to a different container B or a different position of the print image regarding the height and a fine adjustment during the printing process in order to offset undesirable overshooting of tolerances.

The first adjustment is a gross adjustment that arises when switching to printing different containers. The adjusting travels in the process are long if applicable between the position of the print image surface for example with a short bottle and a high bottle or a thin bottle with small diameter and a thick bottle with large diameter. The fine adjustment, which requires only a few tenths of a millimeter, takes place during the actual printing.

Figure 4B:
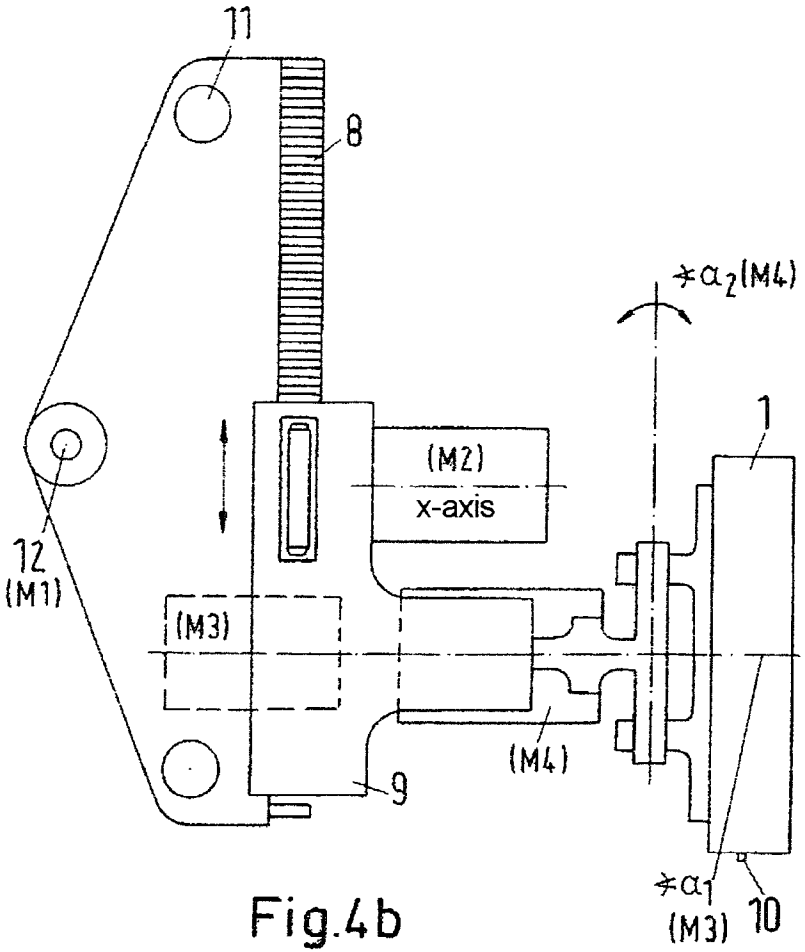
FIG. 4*b* is a top view of the device shown in FIG. 4*a*, FIGS. 5*a* and 5*b* show examples of possible markings on a container for determining the position of the printing head.
Figure 4A:
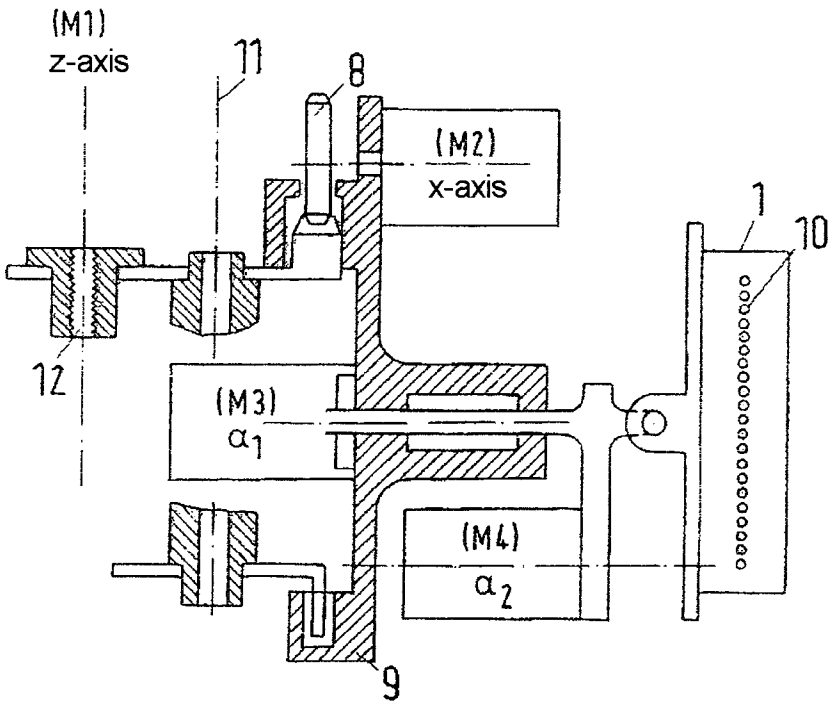
FIG. 4*a* is a sectional view of details of a device for adjusting the printing head in different axes.

FIGS. 4*a* and 4*b* illustrate a possible setup for the adjustment of the printing head 1 in the different axes. FIG. 4*a* does not show the guide of the set-axis and the spindle drive for the height adjustment. FIG. 4*b* shows the same arrangement in top view.

Figure 5A:
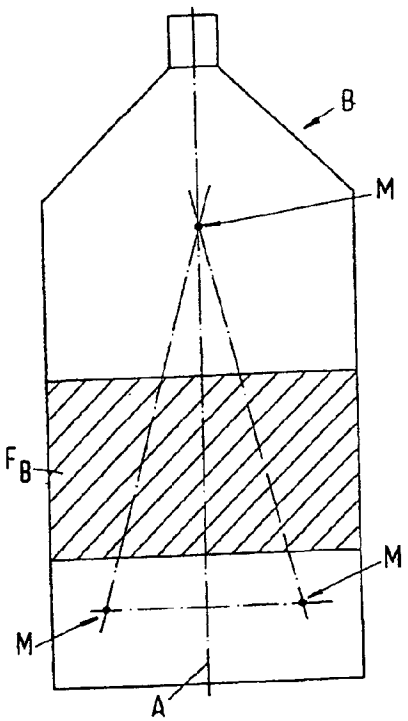

FIG. 5*a* shows an isosceles triangle for use as a marking M for the positioning of the printing head 1 by local coordinates and/or angular position. The triangular points can be located outside or inside the print image surface F. They serve, among other things, for the calculation of the inclined position of the container B and the height of the print image surface F above the turntable 2. When two such triangles have been applied to the container B offset by 90°, the angles $\alpha$1 and $\alpha$2 (see FIGS. 1*d* and 4*a* and 4*b*) are uniquely definable.

Figure 5B:
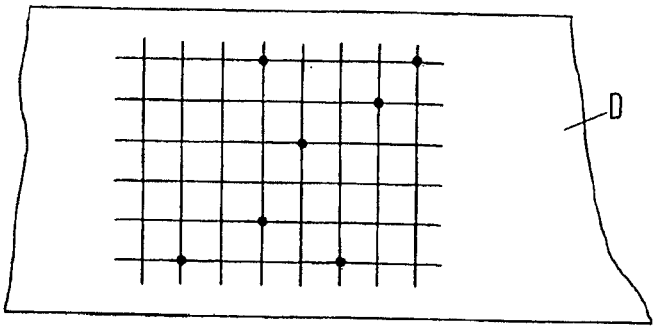

FIG. 5*b* illustrates an example in which individual dots of the print image D itself are used as markings in order to define or calculate the positioning of the printing head 1 relative to the container B and to output a corresponding adjusting signal to the printing head 1.

Figure 6A:
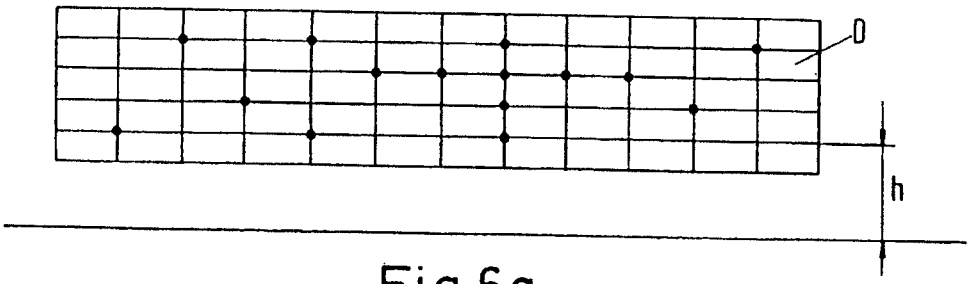
FIGS. 6*a* and 6*b* show a comparison of the development of a print image of a first printing machine on a container in a perpendicular axis position and on a second printing machine with an inclined position randomly resulting there during clamping.
Figure 6B:
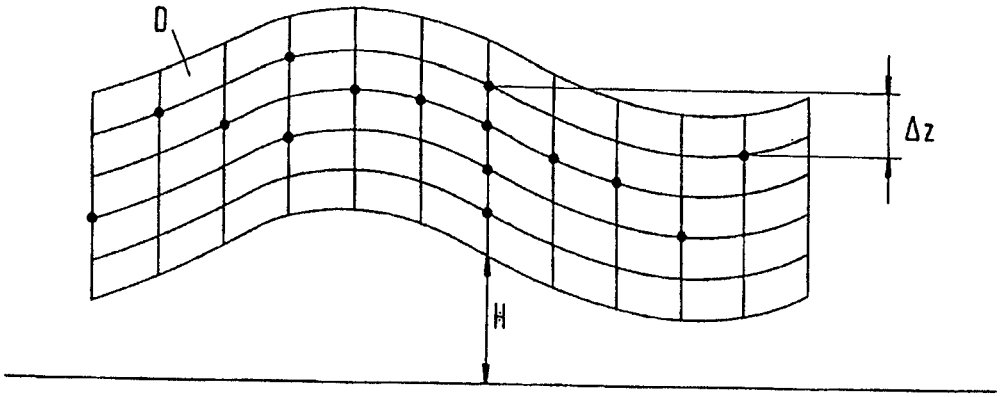

Containers to be printed, such as bottles, can be oval and with eccentric position of the container, like a bottle on the respective turntable 2, as a result of which the container does not rotate about the own axis but that of the turntable. To accommodate these, it is possible, according to the invention, to change the distance between printing head 1 and surface to be printed during a revolution of the container, since the print image D according to FIG. 6*a* on a subsequent printing station presents itself as copy according to FIG. 6*b*.

According to the invention, it is proposed, furthermore, to continuously measure the distance between printing head 1 and container surface by means of sensors in order to readjust the distance value in the x-axis and the angles $\alpha$1 and $\alpha$2 during the rotation of the container. By doing so, a distance to the surface to be printed remains constant even when for example oval bottles are to be printed.

Having described the invention, and a preferred embodiment thereof, what is new and secured by Letters Patent is:

1. An apparatus for printing a design on a container, said apparatus comprising a first plurality of printing stations for printing a first color, a second plurality of printing stations for printing a second color, wherein said second plurality of printing stations follows said first plurality of printing stations, and a controller that operably interlinks said first and second pluralities of printing stations, wherein each printing station from said first and second plurality of printing stations comprises a print head that has an adjustable position and orientation relative to a container, and a measuring device configured to determine said position and orientation of said print head relative to said container, wherein said measuring device comprises sensors that are arranged such that a distance between said print head and said container is continuously measurable, wherein said measuring device is configured to receive, from said sensors, information representative of said position and orientation of said print head relative to said container and to provide said information to said controller, and wherein said position and orientation of said print head relative to said container is adjustable by said controller based at least in part on said information provided by said measuring device.

2. The apparatus of claim 1, wherein said first plurality of printing stations is disposed on a carousel.

3. The apparatus of claim 1, wherein said second plurality of printing stations is configured to print using an ink that differs in color from an ink used by said first plurality of printing stations.

4. The apparatus of claim 1, wherein said first and second pluralities of printing stations operate individually and independently of each other.

5. The apparatus of claim 1, wherein said first and second pluralities of printing stations are interlinked in control.

6. The apparatus of claim 1, further comprising an infeed starwheel, a carousel, a linear conveying device, a clamping device, and a printing station selected from said first and second pluralities of printing stations, wherein said printing station is disposed on said carousel, wherein said infeed starwheel is configured to receive a container from said linear conveying device and to introduce said container into said printing station of said carousel, and wherein said clamping device is configured to center said received container and to place said container into rotation.

7. The apparatus of claim 1, wherein said first plurality of printing stations is configured to print a marker on said container, and wherein said second plurality of printing stations comprises a camera for capturing an image of said marker and emitting an alignment signal for positioning said printing head of said second plurality of printing stations.

8. The apparatus of claim 1, further comprising a UV source, wherein said UV source is configured to cure ink that has been applied to said container.

9. The apparatus of claim 8, wherein said UV source is disposed between said first and second pluralities of printing stations rotary printing machines such that a container that has been printed on by said first plurality of printing stations is illuminated by said UV source on its way to said second plurality of printing stations, whereby ink placed on said container by said first plurality of printing stations is cured when said container arrives at said second plurality of printing stations.

10. The apparatus of claim 1, wherein said first plurality of printing stations is configured to print a marker on said container, and wherein said second rotary printing machine is configured to use said marker as a basis for at least one of positioning and aligning a print head of said second rotary printing machine.

11. The apparatus of claim 10, wherein said marker includes an irregular polygon.

12. The apparatus of claim 10, wherein said marker includes an isosceles triangle.

13. The apparatus of claim 10, wherein said marker is part of said design.

14. The apparatus of claim 10, wherein said first plurality of printing stations is disposed on a carousel, wherein each of said printing stations is configured to rotate said container during a revolution of said carousel by at least one complete rotation while said container is being printed upon.

* * * * *